US012312921B2

(12) United States Patent
Adewuya et al.

(10) Patent No.: US 12,312,921 B2
(45) Date of Patent: May 27, 2025

(54) ADAPTED MUD LINE SUSPENSION SYSTEM

(71) Applicant: SAUDI ARABIAN OIL COMPANY, Dhahran (SA)

(72) Inventors: Opeyemi Adewuya, Dhahran (SA); Hasan Mugabgab, Dhahran (SA); Abdullah Atiyah, Dhahran (SA); Yousif Abu Ahmad, Dhahran (SA); Mohammed Ghamdi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/321,909

(22) Filed: May 23, 2023

(65) Prior Publication Data

US 2024/0392658 A1 Nov. 28, 2024

(51) Int. Cl.
*E21B 43/10* (2006.01)
*E21B 33/04* (2006.01)

(52) U.S. Cl.
CPC ..... *E21B 43/10* (2013.01); *E21B 33/04* (2013.01)

(58) Field of Classification Search
CPC ..... E21B 43/10; E21B 33/04
See application file for complete search history.

(56) References Cited

U.S. PATENT DOCUMENTS 4,083,408 A * 4/1978 Milam ..... E21B 33/12 166/387
4,422,507 A * 12/1983 Reimert ..... E21B 33/043 166/348

* cited by examiner

*Primary Examiner* — Yanick A Akaragwe
(74) *Attorney, Agent, or Firm* — Vorys, Sater, Seymour and Pease LLP

(57) ABSTRACT

A wellbore system includes a mudline suspension system arranged to provide a pressure rating sufficient for performing operations within a wellbore. The wellbore system includes a conductor pipe installed through a subaquatic surface location, and at least one casing string hung from an interior of the conductor pipe into the wellbore. A split casing string extends through the at least one casing string, includes a downhole liner portion hung from a lower end of the at least one casing string and an uphole tieback portion sealed to an interior surface of the lower liner portion. A wellhead supports the split casing string, wherein the upper tieback portion of the split casing string is hung from the wellhead.

17 Claims, 5 Drawing Sheets

ADAPTED MUD LINE SUSPENSION SYSTEM

FIELD OF THE DISCLOSURE

The present disclosure relates to a mudline suspension system for supporting casing within a wellbore and, more specifically, the disclosure relates to mudline suspension systems adapted to maintain structural integrity when subjected to greater subsurface pressures than mudline suspension systems may have been rated.

BACKGROUND OF THE DISCLOSURE

Hydrocarbon resources are often located below the earth's surface, sometimes tens of thousands of feet below the surface. Sometimes hydrocarbon fluids, e.g., oil and/or gas, reside in terrestrial locations and sometimes in geologic formations that lie beneath a body of water. In order to extract the hydrocarbon fluid, wellbores may be drilled through the geologic formations to access subterranean hydrocarbon reservoirs. The wellbores may be drilled vertically, and also deviated from vertical, to access the hydrocarbon fluids.

The wellbores may be cased to protect the integrity of the wellbores and the surrounding geologic formations. Casing strings may be fixed in place by injecting cement into an annulus defined between the casing and the surrounding geologic formation. Where a smaller casing string extends through a larger casing string, cement may be injected into an annulus between the outer diameter of the smaller casing string and the inner diameter of the larger previous casing string. For some applications, a liner may be installed in place of a casing string. A primary distinction between a liner and casing is that casing extends from the bottom of the hole to the surface and is supported by a wellhead, whereas liner only runs as high as the previous casing string and is anchored within the previous casing string.

Mud Line Suspension (MLS) systems are often utilized in offshore wellbore construction, where casing is secured within a conductor pipe at the mudline or seabed. An MLS system generally includes a series of concentric hangers equipped with load supporting shoulders that transfer the weight of each casing string to the conductor and the sea bed. MLS systems provide operators with flexibility of temporarily abandoning a wellbore and tying back to the well at a later dated as needed.

MLS systems are generally categorized according to mechanical loads and pressures that the MLS systems are designed to handle. Standard configurations include a 5,000 psi (5M) rated Mud Line Compact (MLC) system and a Mud Line Long (MLL) system rated to 15,000 psi (15M) capacity. In some instances, a need may arise to subject an MLS system to greater loads than the rating of the MLS system. Additionally, a standard MLS configuration may not be the most cost-effective solution for every application.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a wellbore system includes a conductor pipe installed through a subaquatic surface location. At least one casing string is hung from a mudline suspension profile defined within an interior of the conductor pipe, and the at least one casing string extends into a wellbore defined below the conductor pipe. A split casing string extends through the at least one casing string and includes a downhole liner portion hung from a lower end of the at least one casing string below the mudline suspension hanger profile and an uphole tieback portion sealed to an interior surface of the lower liner portion and passing upwardly through the mudline suspension hanger profile. A wellhead is defined above the mudline suspension hanger profile, and the upper tieback portion of the split casing string is hung from the wellhead such that the uphole tieback portion bypasses the mudline suspension hanger profile.

According to another embodiment consistent with the present disclosure, a method of conducting operations in a wellbore includes (a) installing a conductor pipe through a subaquatic surface location into a geologic formation below the subaquatic surface location, (b) hanging at least one casing string from a mudline suspension hanger profile defined within an interior of the conductor pipe into the wellbore, (c) hanging a downhole liner portion of a split casing string from a lower end of the at least one casing string below the mudline suspension hanger profile, (d) passing an uphole tieback portion through the mudline suspension profile to an interior of the downhole liner portion and (c) supporting the uphole tieback portion from a wellhead installed above the mudline suspension profile such that the uphole tieback portion bypasses the mudline suspension hanger profile.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
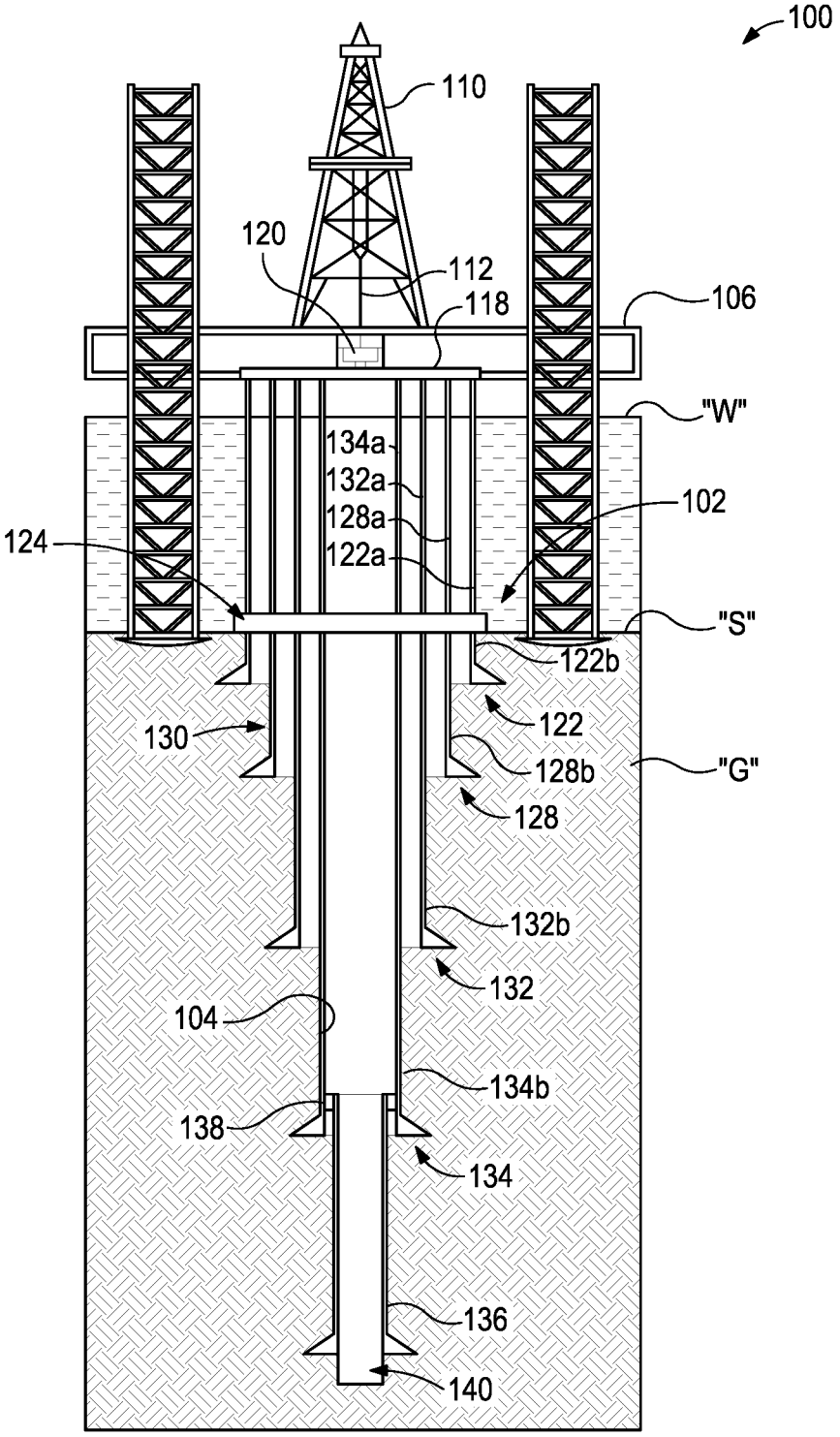
FIG. 1 is a cross-sectional schematic view of a wellbore system including a mudline suspension system in accordance with one or more aspects of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to mudline suspension (MLS) systems that employ components of a standard MLS system but are adapted to accommodate greater loads than the standard MLS system. For example, a standard MLS system may be rated to 5000 psi (5M) at a 9⅝" casing hanger profile, while a modified casing configuration as described herein may elevate the pressure rating to 10,000 psi (10M) by bypassing the 9⅝" casing hanger profile.

Mudline suspension systems of the present disclosure include an intermediate casing string in a wellbore that is split into a lower cemented liner and an upper tieback portion supported at the wellhead to bypass a lower rated mudline suspension hanger profile. For example, the upper tieback portion may "bypass" the mudline suspension hanger profile by passing through the mudline suspension hanger profile without being supported thereby and without being coupled thereto. In some specific embodiments, 30-inch, 18⅝-inch and 13⅜-inch casing hangers of a standard MLC system are used and a 9⅝-inch casing is split to bypass a 5,000 psi (5M) rated mudline suspension hanger profile. The resulting MLS system may be rated a 10,000 psi (10M) capacity. In some embodiments, a 9⅝-inch tieback portion of the split casing may be cemented into place, and the wellbore may be completed by tying back to a 7-inch liner supported by a 9⅝-inch liner portion of the split casing. In other embodiments, the 9⅝-inch tieback portion may not be cemented into place, and the wellbore may be completed by removing the 9⅝-inch tieback portion and tying back to a 13⅜-inch casing.

FIG. 1 is a schematic diagram of an example wellbore system 100 that may embody or otherwise employ one or more principles of the present disclosure. In the illustrated embodiment, the wellbore system 100 includes a Mudline Suspension (MLS) system 102 extending below a subaquatic surface location "S," such as a seabed or lake bottom. The MLS system 102 supports a wellbore 104 extending through a geologic formation "G." In the illustrated example, the wellbore 104 is substantially vertical. In other embodiments, aspects of the disclosure may be practiced in a wide variety of vertical, directional, deviated, slanted and/or horizontal portions therein, and may extend along any trajectory through the geologic formation "G."

A platform 106 is positioned above a water surface "W" and may facilitate drilling the wellbore 104 and installing the MLS system 102. In the example embodiment illustrated, the platform 106 is a jack-up rig supported on the geologic formation "G." In other embodiments, the platform 106 may include a ship or other platform floating on the water surface "W" without departing from the scope of the disclosure. The platform 106 supports a drilling rig 110 thereon for handling a drill pipe 112. The drill pipe 112 may be extended into the wellbore 104 through a conductor pipe 130 that extends between the platform 106 and the geologic formation "G." The drill pipe 112 may be rotated to drill the wellbore 104 using techniques recognized in the art. The platform 106 also supports a surface wellhead 118 and a BOP stack 120 to contain drilling fluids and protect drilling personnel while the wellbore 104 is being drilled. Once the wellbore 104 is complete, the platform 106 may be removed, and/or the wellbore 104 may be temporarily suspended as described in greater detail below.

The MLS system 102 generally supports the weight of casing strings within the wellbore 104 at the subaquatic surface "S" and provides the ability to disconnect and reconnect from the wellbore 104 as needed. The MLS system 102 includes a mudline suspension hanger profile 124 defined within the conductor pipe 122 at or near the subaquatic surface "S." The conductor pipe 122 may have a 30-inch nominal diameter and may be set 200 feet (or at an alternate depth determined to be within a service capacity of the conductor pipe 122) into the geologic formation "G" below the subaquatic surface "S." The conductor pipe 122 may be installed through the subaquatic surface "S" with a pile driver, by drilling or by alternative methods. The surface wellhead 118 may be coupled to an upper end of the conductor pipe 122 or other tubulars while drilling or other operations are being conducted in the wellbore 104. As described in greater detail below, when drilling is completed and the MLS system 102 is fully installed, the conductor pipe 122 may be severed (cut) at the mudline suspension hanger profile 124, and an upper portion 122*a* of the conductor pipe 122 may be removed. A lower portion 122*b* of the conductor pipe 122 may remain in place, and may receive a corrosion cap (not shown) or other protective structures when the wellbore 104 is temporarily suspended.

A surface casing string 128 may be extended concentrically within the conductor pipe 122 from the surface wellhead 118 and into the wellbore 104. An upper portion 128*a* of the surface casing string 128 extends between the platform 106 and the mudline suspension hanger profile 124. A lower portion 128*b* of the surface casing string 128 may be supported on a landing shoulder 308 (FIG. 3) defined within the conductor pipe 122 at the mudline suspension hanger profile 124. The surface casing string 128 may have a nominal diameter of 18⅝ inches and may extend to a depth of about 650 feet (or to an alternate depth determined to be within a service capacity of the surface casing string 128) in some embodiments. The length and depth of the casing strings described herein may vary depending on the casing size and strength, and the external forces (e.g., hydrostatic gradient (pore pressure) and internal pressures (drilling fluid weight)) experienced by the casing strings. Any specific values given herein for the length or depth of a casing string are exemplary only.

The lower portion 128*b* of the surface casing string 128 may be cemented into place, e.g., an annulus 130 defined between the lower portion 128*b* of the surface casing string 128 and the lower portion 122*b* of the conductor pipe 122 and geologic formation "G" may be filled with cement. Other casing strings described herein may similarly be cemented in place. The surface casing string 128 may have a pressure rating of 1,500 psi (or an alternate pressure rating indicating a maximum operating pressure of the surface casing string 128) to permit drilling and other wellbore operations below the surface casing string 128.

Within the surface casing string 128, a first intermediate casing string 132 may be extended from the surface wellhead 118 and into the wellbore 104. An upper portion 132*a* of the first intermediate casing string 132 extends between the platform 106 and the mudline suspension hanger profile 124. A lower portion 132*b* of the first intermediate casing string 132 may be hung at the mudline suspension hanger profile 124 and cemented in place. Specifically, the lower portion 132*b* of the first intermediate casing string 132 may be hung from an interior shoulder 316 (FIG. 3) on an interior of the surface casing string 128. In other example embodiments, the lower portion 132*b* of the first intermediate casing string 132 may be hung from an interior surface of the conductor pipe 122 at the mudline suspension hanger profile 124. The first intermediate casing string 128 may have a nominal diameter of 13⅜ inches and a pressure rating of 4,500 psi (or an alternate pressure rating indicating a maximum operating pressure of the first intermediate casing string 132). The first intermediate casing string 132 may extend to a depth of about 2,500 feet (or to an alternate depth determined to be within a service capacity of the first intermediate casing string 132) in some example embodiments.

A second intermediate casing string 134 may be extended concentrically through the first intermediate casing string 132 from the surface wellhead 118 and into the wellbore 104. An upper portion 134*a* of the second intermediate casing string 132 extends between the platform 106 and the mudline suspension hanger profile 124. A lower portion 134*b* of the second intermediate casing string 132 may be hung from the mudline suspension hanger profile 124 and cemented in place. The second intermediate casing string 134 may have a nominal diameter of 9⅝ inches and a pressure rating of 5,000 psi (or an alternate pressure rating indicating a maximum operating pressure of the second intermediate casing string 134). The second intermediate casing string 132 may extend to a depth of about 4,500 feet (or to an alternate depth determined to be within a service capacity of the second intermediate casing string 134) in some example embodiments.

As illustrated in FIG. 1, in some example embodiments, a liner 136 may be hung from a lower end of the second intermediate casing string 134. The liner 136 may have a nominal diameter of 7 inches and may extend to a depth of 7,000 feet (or to an alternate depth determined to be within a service capacity of the liner 136) in some embodiments. The liner 136 may be supported by a liner hanger 138 on an interior of the second intermediate casing string 134. An open-hole portion 140 of the wellbore 104 may be provided below the liner 136.

The MLS system 102 may have a pressure rating of 5,000 psi for operations within and below the second intermediate casing string 134. The upper portions 122*a*, 128*a*, 132*a* and 134*a* may each be removed when these operations are complete, and the MLS system 102 may be capped at the mudline suspension hanger profile 124 to temporarily suspend the wellbore 104.

Figure 2:
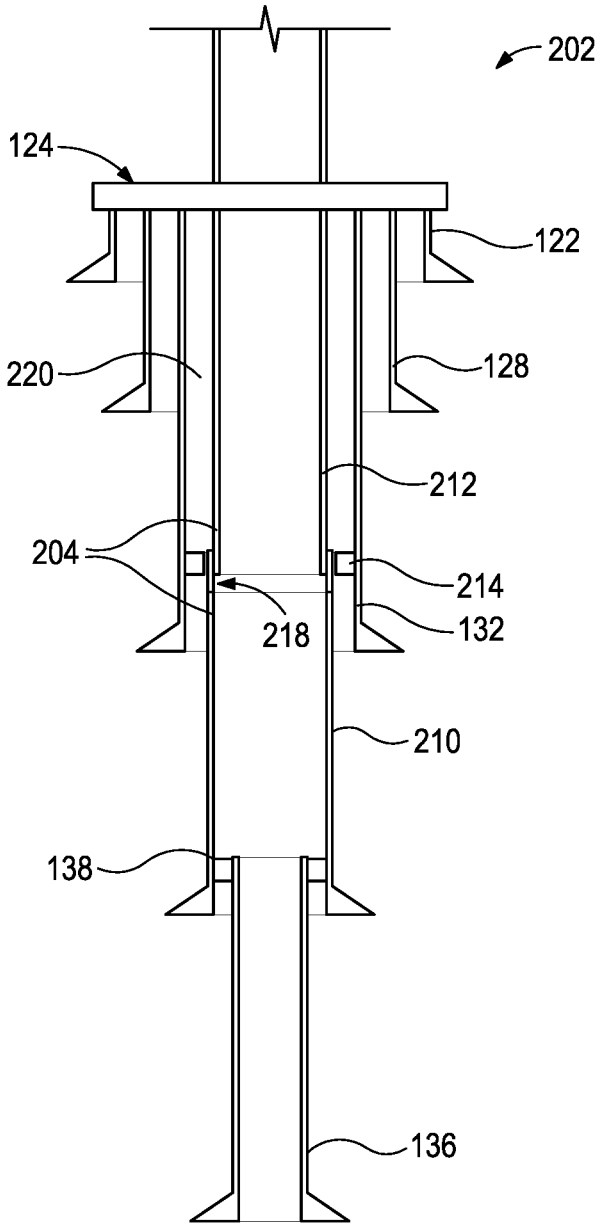
FIG. 2 is a schematic view of a mudline suspension system, which may be adapted from the mudline suspension system of FIG. 1 or installed in place of the mudline suspension system of FIG. 1 to accommodate greater subsurface pressures.

Referring now to FIG. 2, an example MLS system 202 is described, which may be rated for subsurface pressures of up to 10,000 psi for applications where an anticipated subsurface pressure within a wellbore falls between 5,000 psi and 10,000 psi. The MLS system 200 includes many of the same components as the MLS system 102 of FIG. 1, and thus may be best understood with reference thereto. For example, the conductor pipe 122, mudline suspension hanger profile 124, surface casing string 128 and first intermediate casing string 132 may each be identically constructed and arranged as in the MLS system 102 (FIG. 1). Rather than a second intermediate casing string 134 extending to the mudline suspension hanger profile 124, however, the MLS system 202 includes a split casing string 204 disposed within the first intermediate casing string 132.

The split casing string 204 includes a downhole liner portion 210 and an uphole tieback portion 212. The downhole liner portion 210 may have a nominal diameter of 9⅝ inches, and may be cemented in place to a depth of about 4,500 feet in some example embodiments, similar to the second intermediate casing string 134 (FIG. 1). However, rather than being supported near the mudline suspension hanger profile 124, the downhole liner portion 210 is supported by a liner hanger 214 disposed at or near a lower end of the first intermediate casing string 132. The uphole tieback portion 212 couples to the downhole liner portion 210 at a Polished Bore Receptacle (PBR) 218 defined within an interior of the downhole liner 210. The uphole tieback portion 212 is sealed to the downhole liner portion 210 with a seal assembly (not shown) and extends through the mudline suspension hanger profile 124. An upper end of the uphole tieback portion 212 may be secured to the surface wellhead 118 (see FIG. 4). In other embodiments, the upper end of the of the uphole tieback portion 212 may be secured to the conductor pipe 122 above casing hangers 310, 312 (FIG. 3) in the mudline suspension hanger profile 124.

In some example embodiments, the uphole tieback portion 212 may be cemented in place, e.g., by filling an annulus 220 between the first intermediate casing string 132 and the uphole tieback portion 212 with cement. In other example embodiments, the annulus 220 may be devoid of cement such that the uphole tieback portion 212 is left un-cemented to facilitate removal of the uphole tieback 212 from the first intermediate casing string 132. Once the split casing string 204 is installed, the MLS system 202 may be rated at 10,000 psi.

In some example embodiments, as illustrated in FIG. 2, the liner 136 may be hung from a lower end of the downhole liner portion 210. As described above, the liner 136 may have a nominal diameter of 7 inches and may extend to a depth of 7,000 feet (or to an alternate depth determined to be within a service capacity of the liner 136). The liner 136 may be supported by a liner hanger 138 arranged on an interior of the downhole liner portion 210 such that the lowermost end of the MLS system 202 is similar in construction to the MLS system 101 of FIG. 1.

Figure 3:
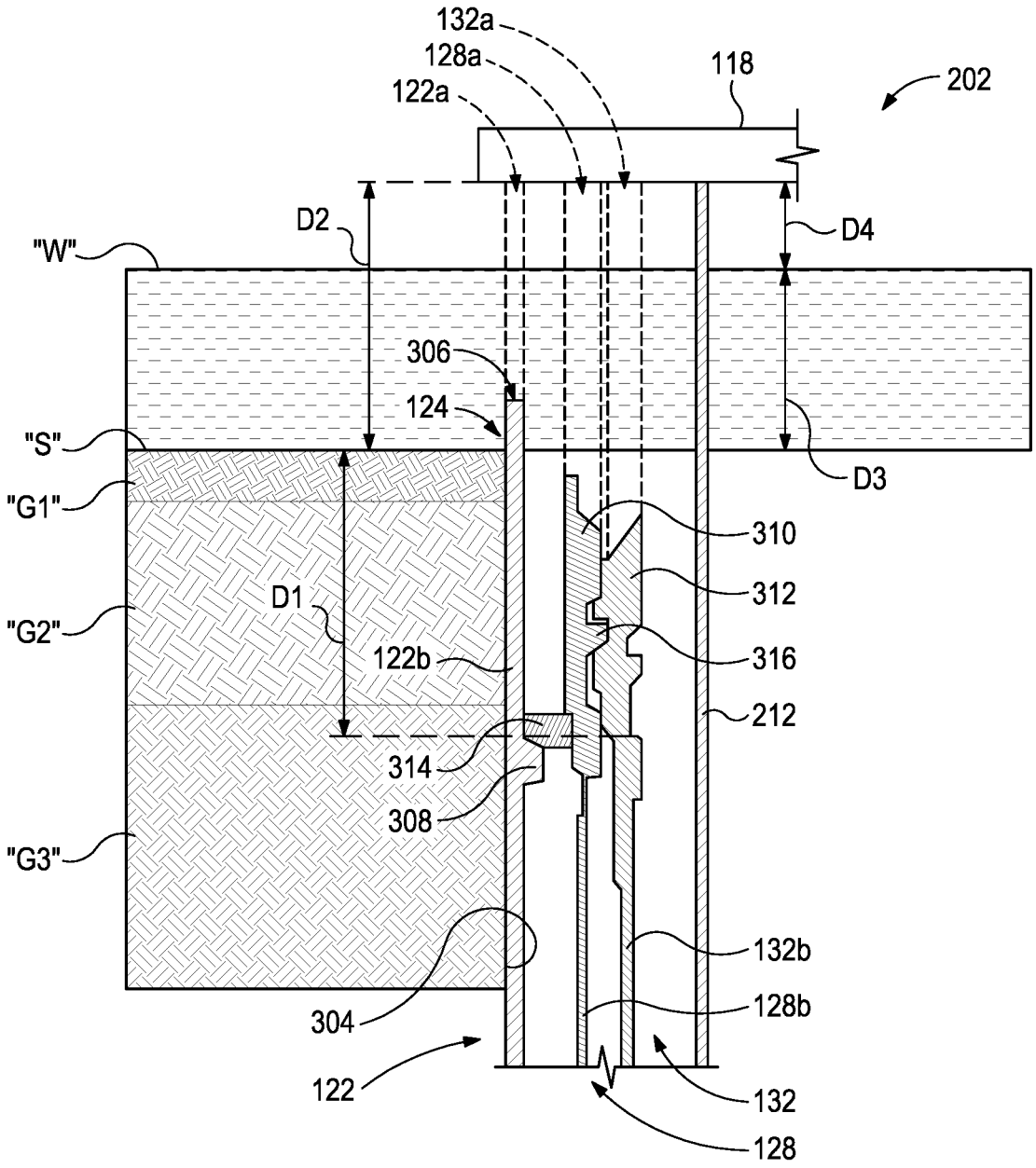
FIG. 3 is a partial schematic view of the mudline suspension system of FIG. 2 illustrating a mudline suspension hanger profile for supporting one or more casing strings within in a wellbore from near a mudline or other subaquatic surface location, and an upper tieback portion of a casing string bypassing the mudline suspension hanger profile in accordance with one or more aspects of the present disclosure.

Referring now to FIG. 3, illustrated is a partial schematic view of the MLS system 202 installed in a wellbore 304. The conductor pipe 122 is installed through the subaquatic surface location "S" into the geologic formation "G." The conductor pipe 122 may extend through a mud layer G1, an unconsolidated earth layer G2 and a rock layer G3 of the geologic formation "G." As illustrated in FIG. 3, the conductor pipe 122 has been severed to define an upper edge 306 at or near the subaquatic surface location "S." An upper portion of 122*a* of the conductor pipe 122 has been removed. The mudline suspension hanger profile 124 is defined within the conductor pipe 122, and includes a landing shoulder 308 at a depth D1, which may be within the rock layer G3 in some embodiments. For example, the depth D1 may be about 15 feet below the subaquatic surface location "S."

The landing shoulder 308 may support first and second casing hangers 310, 312 of the mudline suspension hanger profile thereon. The first and second casing hangers 310, 312 may be carried to the landing shoulder 308 by the upper portions 128*a*, 132*a* of the surface casing string 128 and the first intermediate casing string 132, respectively. The upper portions 128*a*, 132*a* may remain in place, connecting the surface wellhead 118 to the wellbore 304, until such time the wellbore 304 is to be temporarily suspended. As illustrated in FIG. 3, the upper portions 128, 132 have been removed from the first and second casing hangers 310, 312. The first casing hanger 310 engages a landing ring 314, which rests on the landing shoulder 308. The second casing hanger 312 is supported on an interior shoulder 316 defined within the first casing hanger 310. The first casing hanger 310 supports the lower portion 128*b* of the surface casing string 128 in the wellbore 304 and the second casing hanger 312 supports the lower portion 132*b* of the first intermediate casing string 132 in the wellbore 304.

The uphole tieback portion 212 of the split casing string 204 extends radially within the first intermediate casing string 132. The uphole tieback portion 212 extends upwardly through the subaquatic surface "S," bypassing the mudline suspension hanger profile 124, and upward for a second distance D2 to the surface wellhead 118. In some embodiments, the distance D2 may be about 168 feet including a water depth D3 of about 60 feet and a distance D4 above the water surface "W" (generally referred to as the air gap) of about 108 feet. The uphole tieback portion 212 may be supported by the surface wellhead 118.

Figure 4:
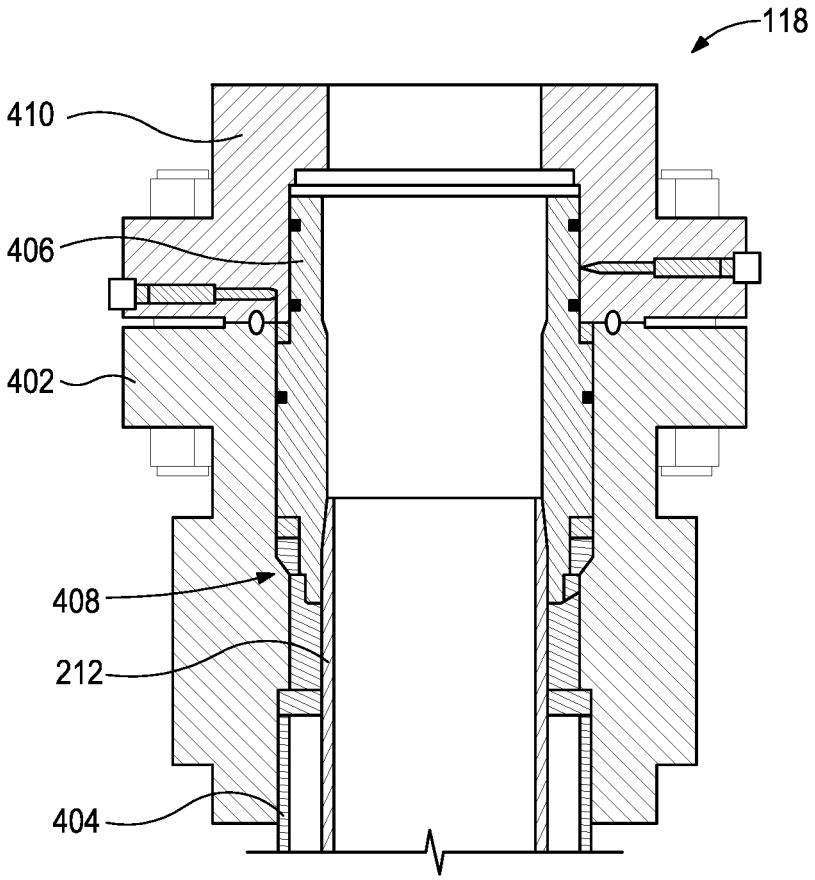
FIG. 4 is a partial cross sectional view of a surface wellhead supporting the upper tieback portion of FIG. 3 from above the mudline suspension hanger profile.

Referring now to FIG. 4, illustrated is a partial cross-sectional view of the surface wellhead 118 with the uphole tieback portion 212 supported therein. The surface wellhead 118 includes a casing head 402 to which a riser 404 or conductor pipe 122 is secured. The casing head 402 may be threaded onto the top of the riser 404, or the casing head 402 and the riser 404 may be welded to one another in some embodiments. A casing hanger 406 is supported on a shoulder 408 within the casing head 402, and a casing spool 410 is secured to an upper end of the casing head 402 enclosing the casing hanger 406 within an interior of the surface wellhead 118. The casing hanger 408 supports the upper tieback portion 212 therein such that the upper tieback portion 212 may bypass the mudline suspension hanger profile 124 (FIG. 3) by passing therethrough and without being supported thereby.

Figure 5:
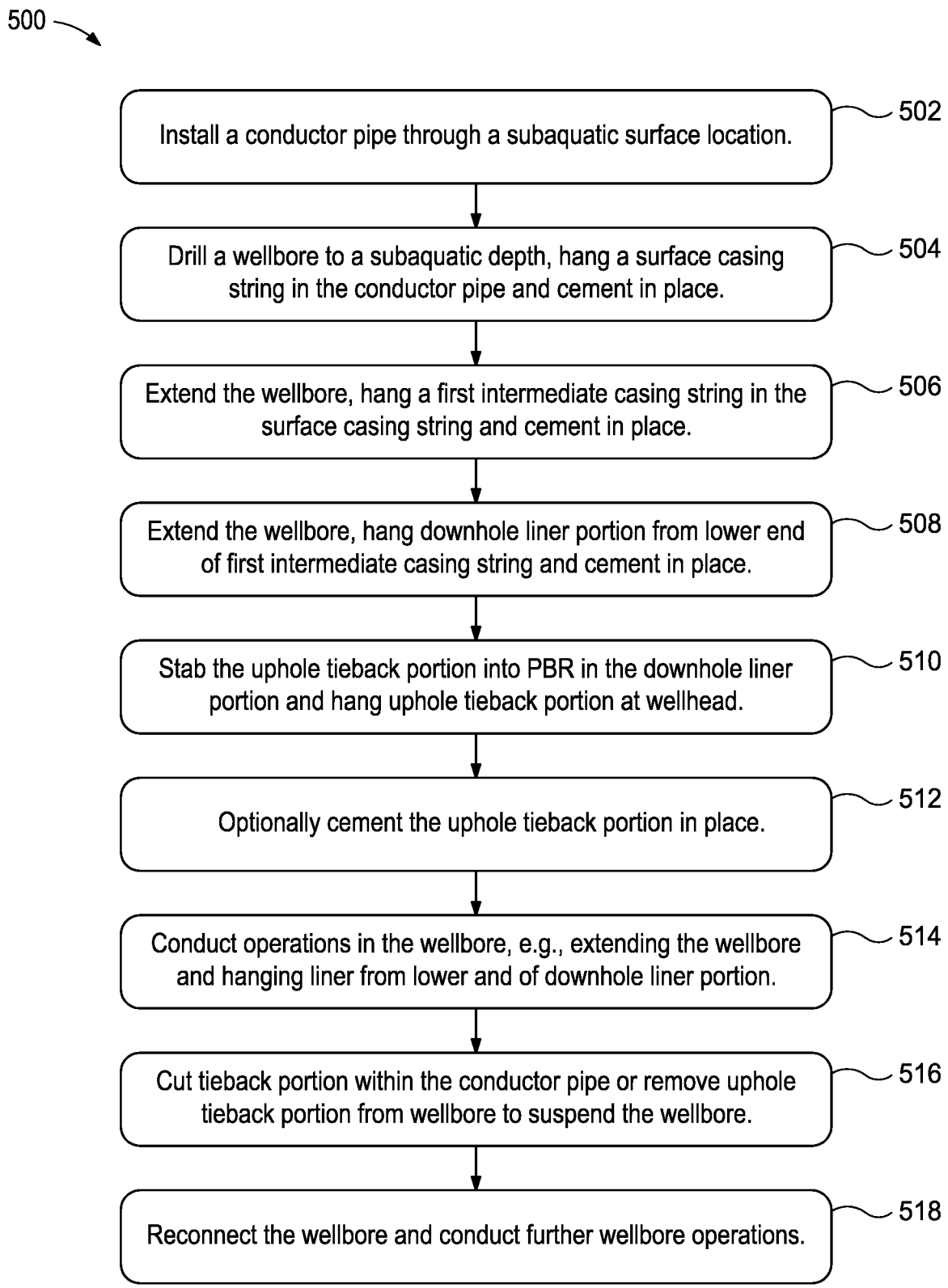
FIG. 5 is a flowchart illustrating an example procedure for installing the mudline suspension system of FIG. 2 in accordance with one or more aspects of the present disclosure.

Referring now to FIG. 5, and with continued reference to FIGS. 1-4, a procedure 500 is described for installing the mudline suspension system 202. Initially at step 502, the conductor pipe 122 is installed through the subaquatic surface location "S." The conductor pipe 122 may be driven into the geologic formation "G" with a pile driver or similar mechanism, or alternatively, the wellbore 304 may be drilled to a depth of about 200 feet (or to an alternate depth determined to be within a service capacity of the conductor pipe) and the conductor pipe 122 may be inserted into the wellbore 304. At step 504, the wellbore 304 may be drilled to a subaquatic depth through the conductor pipe 122, e.g., to a depth of about 650 feet (or an alternate depth determined to be within a surface capacity of the surface casing string 128). The surface casing string 128 may then be hung on the landing shoulder 308 of the conductor pipe and cemented in place in the wellbore 304. With the surface casing string 128 installed, the wellbore 304 may then be rated at 1,500 psi.

At step 506, the wellbore 304 may be extended to a depth sufficient to accommodate the first intermediate casing string 132, e.g., 2,500 feet (or an alternate depth determined to be within a surface capacity of the first intermediate casing string 132). The first intermediate casing string 132 may then be run into the wellbore 304 and hung within the surface casing string 128. The first intermediate casing string 132 may then be cemented into place, and the wellbore may then be rated at 4,500 psi.

At step 508, the wellbore 304 may be extended to a depth sufficient to accommodate the downhole liner portion 210 of the split casing string 204, e.g., 4,500 feet (or an alternate depth determined to be within a surface capacity of the downhole liner portion 210). The downhole liner portion 210 may then be run into the wellbore 304 and hung on liner hanger 214 at a lower end of first intermediate casing string 132. The downhole liner portion 210 may then be cemented into place.

At step 510, the upper tieback portion 212 of the split casing string 204 may be stabbed into the PBR 218 defined within the lower liner portion 210. A seal may be established within the PBR 218, e.g., with a seal assembly (not shown) carried by the upper tieback portion 212. The upper tieback portion 212 may be hung from the surface wellhead 118 to bypass the mudline suspension hanger profile 124. In other embodiments, the upper tieback portion 212 may be hung from the conductor pipe 122, riser 404 or another location above the mudline suspension hanger profile 124. Then the wellbore 304 may then be rated at 10,000 psi. At step 512, the upper tieback portion 212 may optionally be cemented into place by filling annulus 220 with cement.

The procedure 500 may then proceed to step 514 where operations may be conducted in the wellbore 304 (with a rating of 10,000 psi) through the split casing string 204. For example, the wellbore 304 may be extended to a depth sufficient to accommodate the liner 136, e.g., 7,000 feet (or an alternate depth determined to be within a surface capacity of the liner 136). The liner 136 may be hung from liner hanger 138 at lower end or the lower liner portion 210.

At step 516, the wellbore 304 may be suspended. In embodiments where the upper tieback portion 212 has been cemented into place, the upper tieback portion 212 may be cut within the conductor pipe 122. Portions of the upper tieback portion 212 above the cut may then be removed from the wellbore 304. In embodiments where the upper tieback portion 212 has not been cemented into place, the entire upper tieback portion 212 may be removed from the wellbore 304. Appropriate plugs and or caps (not shown) may be installed within the wellbore 304 or at the mudline, e.g., at the subaquatic surface location "S" for safety and to protect the wellbore 304, and the wellbore 304 may be temporarily abandoned or suspended.

At step 518, further operations may be conducted in the wellbore 304 by reconnecting to the wellbore 304. For example, the uphole tieback portion 212 may be re-stabbed into the PBR 218 in embodiments where the uphole tieback portion 212 was removed. Alternatively, an additional tieback (not shown) may be provided to connect the uphole tieback portion 212 to the surface wellhead 118 in embodiments where the uphole tieback portion 212 was cut within the wellbore 304.

It should be appreciated that the steps of procedure 500 may be conducted in alternate orders. Also not every step may be performed in every procedure employing the MLS system 202.

The terminology used herein is for the purpose of describing particular embodiments only and is not intended to be limiting of the invention. As used herein, for example, the singular forms "a." "an," and "the" are intended to include the plural forms as well, unless the context clearly indicates otherwise. It will be further understood that the terms "contains", "containing", "includes", "including," "comprises", and/or "comprising." and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A wellbore system, comprising:

a conductor pipe installed through a subaquatic surface location;

at least one casing string hung from a mudline suspension hanger profile defined within an interior of the conductor pipe, the at least one casing string extending into a wellbore defined below the conductor pipe;

a downhole liner portion hung from a lower end of the at least one casing string below the mudline suspension hanger profile;

an uphole tieback portion sealed to an interior surface of the downhole liner portion below the mudline suspension hanger profile and passing upwardly through the mudline suspension hanger profile; and a wellhead defined above the mudline suspension hanger profile, wherein the uphole tieback portion is hung from the wellhead such that the uphole tieback portion bypasses the mudline suspension hanger profile by extending completely through the mudline suspension hanger profile without any support by the mudline suspension hanger profile.

2. The wellbore system of claim 1, wherein the at least one casing string includes a surface casing string having a first casing hanger supported on a landing shoulder defined within the conductor pipe.

3. The wellbore system of claim 2, wherein the at least one casing string further includes a first intermediate casing string having a second casing hanger supported on an interior shoulder defined within the first casing hanger.

4. The wellbore system of claim 1, wherein the downhole liner portion includes a Polished Bore Receptacle (PBR) defined at an upper end thereof, and wherein the uphole tieback portion is sealed to the PBR.

5. The wellbore system of claim 1, wherein an annulus defined between the first intermediate casing string and the uphole tieback portion is filled with cement.

6. The wellbore system of claim 1, wherein an annulus defined between the first intermediate casing string and the uphole tieback portion is devoid of cement.

7. The wellbore system of claim 1, further comprising a liner hung from a lower end of the downhole liner portion.

8. The wellbore system of claim 1, further comprising a platform disposed above a water surface overlying the subaquatic surface location, wherein the wellhead is a surface wellhead supported on the platform.

9. The wellbore system of claim 1, wherein the downhole liner portion is hung from the lower end of the at least one casing string below the subaquatic surface location.

10. The wellbore system of claim 1, wherein an annular space is defined radially between the uphole tieback portion and the mudline suspension hanger profile.

11. A method of conducting operations in a wellbore, the method comprising:

installing a conductor pipe through a subaquatic surface location into a geologic formation below the subaquatic surface location;

hanging at least one casing string from a mudline suspension hanger profile defined within an interior of the conductor pipe into the wellbore;

hanging a downhole liner portion from a lower end of the at least one casing string below the mudline suspension hanger profile;

passing an uphole tieback portion through the mudline suspension hanger profile to an interior of the downhole liner portion below the mudline suspension hanger profile; and supporting the uphole tieback portion from a wellhead installed above the mudline suspension hanger profile such that the uphole tieback portion bypasses the mudline suspension hanger profile by extending completely through the mudline suspension hanger profile supported any support by the mudline suspension hanger profile.

12. The method of claim 11, wherein hanging the at least one casing string includes hanging a first casing hanger of a surface casing string from a landing shoulder defined within the conductor pipe and hanging a second casing hanger of a first intermediate casing string from an interior shoulder defined within the first casing hanger.

13. The method of claim 11, further comprising suspending the wellbore subsequent to sealing the uphole tieback portion to the interior of the downhole liner portion and reconnecting to the wellbore subsequent to suspending the wellbore.

14. The method of claim 13, wherein suspending the wellbore includes either cutting the uphole tieback portion within the conductor pipe or removing the uphole tieback portion from the wellbore.

15. The method of claim 11, further stabbing the uphole tieback portion into a Polished Bore Receptacle (PBR) defined within the downhole liner portion.

16. The method of claim 11, further comprising hanging a liner from a lower end of the downhole liner portion.

17. The method of claim 11, further comprising drilling the wellbore from a platform disposed above a water surface overlying the subaquatic surface location, and wherein supporting the uphole tieback portion from the wellhead includes hanging the uphole tieback portion from a surface wellhead supported on the platform.

* * * * *